US005593072A

United States Patent [19]

Hester et al.

[11] Patent Number: 5,593,072

[45] Date of Patent: Jan. 14, 1997

[54] AUTOMATED GARMENT FINISHING SYSTEM

[75] Inventors: Gary K. Hester, Richardson, Tex.; Conrad L. Fernandez, Charlotte, N.C.; Jon McNeill, Arlington, Tex.; Ted M. Ray, McKinney, Tex.; William Traynor, San Antonio, Tex.

[73] Assignee: Levi Strauss & Co., San Francisco, Calif.

[21] Appl. No.: 468,498

[22] Filed: Jun. 6, 1995

Related U.S. Application Data

[62] Division of Ser. No. 154,853, Nov. 18, 1993, Pat. No. 5,458,265.

[51] Int. Cl.[6] ..... A41H 5/00; A41H 5/02; B65G 37/00

[52] U.S. Cl. ..... 223/120; 223/67; 223/68; 223/66; 223/75; 198/350; 198/465.1

[58] Field of Search ..... 223/68, 72, 73, 223/67, 84, 74, 120, 75, 76, 77, 66; 26/28, 69 C; 198/350, 465.1, 465.3, 803.2

[56] References Cited

U.S. PATENT DOCUMENTS

| | | | |
|---|---|---|---|
| 565,544 | 8/1896 | Keaue et al. | 223/67 |
| 839,431 | 12/1906 | Smith | 223/67 |
| 2,500,992 | 3/1950 | Leef | 223/73 |
| 3,307,162 | 2/1967 | Fink | 340/174.1 |
| 3,405,852 | 10/1968 | Fox | 223/67 |
| 3,486,667 | 12/1969 | McMillan | 223/57 |
| 3,550,820 | 12/1970 | O'Boyle | 223/73 |
| 3,556,361 | 1/1971 | O'Boyle | 223/73 |
| 3,595,450 | 7/1971 | Schlemon | 223/67 |
| 3,613,864 | 10/1971 | Lingg et al. | 198/38 |
| 3,710,994 | 1/1973 | Cherry et al. | 223/67 |
| 3,931,882 | 1/1976 | Ossbahr | 198/165 |
| 4,437,246 | 3/1984 | Sanko | 38/25 |
| 4,845,790 | 7/1989 | Brasington | 8/150 |
| 5,094,371 | 3/1992 | Takamura et al. | 223/76 |

FOREIGN PATENT DOCUMENTS

| | | | |
|---|---|---|---|
| 0377417A1 | 7/1990 | European Pat. Off. | D06B 11/00 |
| 1251331 | 12/1960 | France | 223/67 |

*Primary Examiner*—Bibhu Mohanty
*Attorney, Agent, or Firm*—Medlen & Carroll, LLP

[57] ABSTRACT

An integrated automated manufacturing system for finishing individual garments is provided. The system includes a conveyor system, a fixture constructed for movement on the conveyor in a predetermined orientation, a form mounted on the fixture for holding a garment for finishing in a predetermined fixed orientation relative to the fixture, and finishing stations to which the conveyor carries garments mounted on the fixtures. The fixture mounted form can be inflatable so that the garment mounted thereon can be inflated to its fully extended, three-dimensional form, and the finishing station can include a blower to inflate the form prior to the initiation of a finishing step. The finishing stations can include robot-manipulated tools, such as spray guns or abrasive wheels, for applying chemical or mechanical finishes to selected areas of the fixture mounted garment, washing and drying of the garments, automated garment inspection, or the application of tags and labels to the garments. Typical chemical and mechanical finishes include the application of bleaches or abrasives to selected areas of the garment to fade or wear the garment in those areas, or the application of paint or dye to selected areas to shade the garment or to apply a logo or other design to the selected area. A computer integrates the operation of the system by receiving information from the operator about the physical characteristics of the garments mounted on the fixtures and the finishing steps to be performed, by controlling and tracking the movement of the fixtures on the conveyor, and by controlling operations at finishing stations, including the movement and operation of robots and robot-mounted finishing tools to achieve consistent reproduction of desired chemical or mechanical finishes on individual garments.

22 Claims, 6 Drawing Sheets

AUTOMATED GARMENT FINISHING SYSTEM

This application is a division of copending U.S. patent application Ser. No. 08/154,853 filed on Nov. 18, 1993, now U.S. Pat. No. 5,458,265.

FIELD OF THE INVENTION

The present invention relates to equipment and processes for altering the color or texture of a garment. More particularly, the present invention relates to equipment and processes for finishing individual assembled garments and preparing them for sale.

BACKGROUND OF THE INVENTION

Consumer demand is a driving force in the garment industry. The popularity of denim garments having a faded and worn look have caused many manufacturers of such garments to seek ways of finishing or processing assembled denim garments to provide them with the faded look and soft feel so desirable to the consumer. This has led to the development of equipment and processes for bleaching and abrading assembled jeans to achieve the desired faded and soft look and feel.

In one treatment, called "pre-washing", the garments are simply laundered before sale to remove fabric sizing. This gives the garment a softer appearance and feel, but does not appreciably fade the color of the garment.

Fading (and softening), through mechanical abrasion and/or chemical processing, is typically accomplished in "stone-washing." In this process, the garments are washed in a washing machine along with a suitable abrasive medium such as pumice stones or the like. A dilute solution of bleach is also typically used, either as an impregnate in the stones or as a separate solution added during the wash cycle. As the garments are processed, the stones abrade the surface of the garments, and the bleach fades the color. Control of the concentration of the bleach and the time span of the process is very important since this process can damage the machines and garments. Furthermore, this process produces pumice debris which accumulates in garment pockets, clogs machines and pollutes the environment. Once completed, this process requires additional manufacturing steps to separate the garments from the stones and stone debris.

These and similar methods are typically used to treat a group of garments more or less uniformly at the same time. They change the denim garments from stiff and uniformly colored to worn, faded, and soft. The treated garments are typically more comfortable to wear. However, because these processes involve the treatment of bulk lots of garments, they cannot duplicate the effects of actual wear which produce local variations in the amount of fading, with the heavier fading (and areas of wear) on the front of the thighs, the crotch, and the seat, and along sewn seams and pocket edges.

Hand treatment of jeans has been resorted to in order to duplicate the localized effects of actual wear, since more sophisticated techniques have not been available. Workers wielding wire brushes or sanding wheels or paint sprayers with bleach or sand can fade, abrade or completely wear away specific areas on jeans, producing a faded effect on local areas such as the front thighs or seat.

For example, European patent EP 0 377 417. A1 to Cingolani, discloses a method of locally decolorizing dyed fabric with a jet of hot pressurized water, which avoids the use of chemicals. The garment can be placed on an air-inflatable mannequin, for stretching. When air is blown into the garment it pushes against the inside of the garment and expands it. However, because the water jet must penetrate the fibers in order to fade the cloth, the water pressure must be higher than the mannequin inflation pressure, to obtain the necessary penetration of the fabric by the hot water jet.

In U.S. Pat. No. 4,845,790 to Brasington, a fixture is used to hold jeans for inflation and bleach spraying with a hand-held paint sprayer. The jeans are pre-washed and stone-washed, spun dry, and then while still damp are mounted on a fixture which freely swivels over a large air duct which blows air through the jeans' waist into the garment, inflating it for treatment. The garment is treated on one side, then swivelled around by hand for treatment of the other side. To prevent the jeans from sliding off, the lower perimeter of the swivel sleeve has a circumferential protruding lip over which the jeans waist band rides. A snap clip is used to tuck up extra waist band material of the jeans on one side. (The jeans are thus slightly off-center when mounted on the swivel sleeve.) Two more clips are required to close off either leg sufficiently to stop up the air flow and inflate the garment. Because the garments being treated are porous, the air being pumped into the garment to inflate it is also being forced out through the garment pores. This acts as a countercurrent against the bleach being sprayed onto the garment, and tends to prevent penetration of the bleach into the fabric. Furthermore, like the European Patent to Cingolani, this process is not adaptable to mass-production, depends for the success of its results on the skill of the individual who wields the spray mechanism, and thus is not capable of reproducing with precision substantially identical effects from one garment to the next.

Therefore, the need exists for automated equipment and processes for producing specific, desired local finishes, such as variations in the amount of fading of an assembled garment to simulate the effects of actual wear, which are capable of being substantially identically reproduced from garment to garment on large numbers of assembled garments.

SUMMARY OF THE INVENTION

The present invention provides an automated, microprocessor controlled finishing system for treating garments individually. A finishing system of the present invention is adapted to assembly line production using industrial robots. The present invention can be used to apply various localized effects, such as, for example, bleaching or fading across the front of a pair of jeans trousers from the bottom of the front pockets to the knees and in the seat, or the application of logos, special shaded areas, or other designs to individual garments. The present invention can also be used, as well, for finishing the entire garment, rather than just selected areas on the garment.

The present invention includes a movable fixture which fixes the orientation of a garment and travels on a conveyor to various finishing and treatment stations. At a loading station on the conveyor, information concerning the garment is provided to a computer and the garment is placed over and secured to an inflatable form mounted on the fixture so that the orientation of the garment relative to the fixture does not change. The inflatable form is sized to fit a wide range of garment sizes, so that when the inflatable form is inflated, the garments will be stretched to its natural "full" position and wrinkles will be eliminated regardless of the garment size. Inflating the garment to its three dimensional form is particularly desirable because the accurate reproduction of many desirable finishes, including fading selected areas on the garment, requires consideration of arcuate left-right symmetry which, in turn, requires a known orientation of the garment. For example, in treating jeans to fade the fronts of the thighs, the effect will be ruined if one leg is more faded than the other, or if the left faded area is shaped differently from the right faded area, or if the faded area produced on the outside of the leg is faded more than the area centered on the top of the thigh.

The fixture moves on the conveyor to a finishing station where the fixture is positioned over an air duct which inflates the inflatable form, stretching the garment to remove wrinkles, presenting a smooth surface for finishing.

A robot controlled by the microprocessor is used to provide the desired finish to selected regions of each garment, for example with potassium permanganate bleach. Almost anything that a human operator could hold in his or her hand for finishing, such as a spray nozzle, sandblast nozzle, paint brush, air brush, or abrasive device can be mounted for operation on a computer-controlled robot arm. Use of a robot can be particularly advantageous in reproducing some effects which are almost impossible to duplicate by human workers armed with ordinary spray and sandblast tools. For example, a wallet or can of chewing tobacco or snuff, constantly carried in one pocket of a pair of jeans, will cause a visible faded outline around it—a distinctive effect of actual wear. To consistently reproduce such an effect on thousands of pairs of new jeans would require a level of consistent artistry difficult, if not impossible, for human operators to achieve. However, a robot with a spray nozzle can be programmed to direct a fine spray of a bleaching agent to create the same faded outline design of a tobacco can or wallet on every pair of jeans that it treats. Aside from their advantages of repeatability and reliability, robots have other advantages for garment treatment. A robot is unaffected by bleaches, sand, dyes and other agents which can adversely affect human operators. A robot can perform its functions in a closed booth, keeping noise, dust, and any pollutants which may be created during finishing out of areas where human operators perform their work.

Once the finishing step is completed, the fixture can be moved on the conveyor to other finishing stations (for example, sand blasting, or localized dyeing or painting, or washing and drying of the entire garment).

Each fixture is preferably provided with its own unique identification number, and sensors at various points along the conveyor to enable the microprocessor to track the location of each fixture, and control its path to maximize the efficiency of the system and minimize the time required to process a batch of garments. Thus, when the fixture arrives at a finishing station, the sensor reads the fixture's identification number and informs the microprocessor. Because the operator provided the microprocessor with information concerning the size of the garment, and the specific kind of processing required, when the garments were placed on the fixtures, the microprocessor has only to refer to a look-up table or a set of numerical conditions in its memory which correspond to the parameters for achieving the desired processing, and provide those operating parameters to the robot.

In one embodiment, a fixture is provided for the treatment of pants. The frame of the pants fixture includes a rectangular slab-shaped base for moving on a conventional conveyor of the type having side rails and transverse rollers. A pair of pants is mounted upside-down on the fixture, with the legs extending away from the top surface of the fixture and the waist band over a pair of movable, generally semicircular curved bands or waist straps which are slidably mounted on the top surface of the fixture to allow expansion along one axis. These two waist straps together have an oval or waist-shaped outline and can slide apart to accommodate a wide variety in waist sizes of variously sized pairs of jeans. An inflatable form shaped generally like a pair of trousers with a lower body portion and two legs, is preferably located inside the waist straps. The inflatable form is preferably constructed from a coated fabric and is fastened at its waistline to the waist straps. A leg rod extends from the base upward through each leg of the inflatable form, and terminates in a spring-loaded leg end for properly orienting the inseams and side seams, and for holding the cuffs of the pants in a fully extended position by friction when the pants are pulled over the form.

Other objects, features, advantages and embodiments of the present invention will become apparent to one skilled in the art from reading the Detailed Description of the Invention together with the drawings.

DETAILED DESCRIPTION

Figure 1:
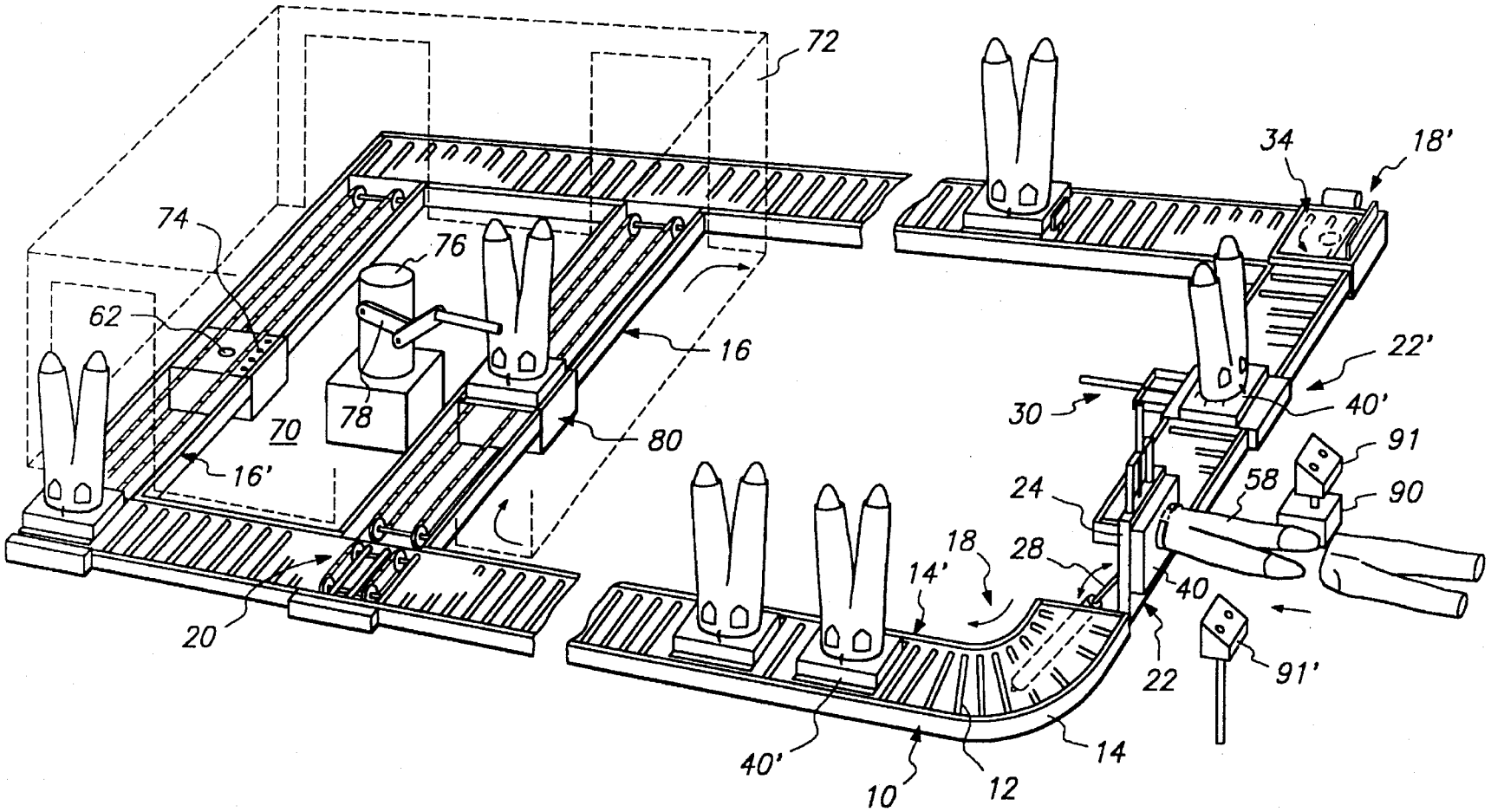
FIG. 1 is a perspective overview of a system of the present invention showing the conveyor with fixtures, a robot at a work station in a booth, and a loading and unloading station.

The preferred embodiment of the invention, illustrated in FIGS. 1, 5, and 6–8, includes a conveyor 10 for carrying fixtures 40, on which individual garments are mounted, to various processing stations 70 for finishing. "Finishing" as used in this application includes the application of chemical or mechanical agents to provide aged or faded effects on selected (local) areas of the garment, the application of dyes or paints to produce logos, shaded areas, or other designs on selected areas of the garment, the application of softening agents to the entire garment, and washing, drying, and applying tags. The movement of the fixtures 40 to the various finishing stations 70, and the operation of the equipment at each station, is controlled by a microprocessor or computer 90. The source code for the computer programs used to perform the functions described in detail below has been filed with U.S. patent application Ser. No. 08/154,853 filed Nov. 18, 1993, which is incorporated herein by reference as a microfiche appendix. This appendix includes two different sets of code: one referred to as LAS CODE which is the primary code used by the microprocessor for controlling the functions described in detail below; the other, called LEVIBUG.MON contains some routines used by LAS CODE, provides a debugging tool, and is used to power up the system and set up pointers and the environment.

Conveyor 10 preferably employs rollers 12 installed on bearings between side rails 14, 14' and driven by a conventional drive mechanism, such as a chain drive 32. The rails 14, 14' extend up above the rollers 12 to maintain the alignment of the fixtures 40 and to keep the fixtures 40 from sliding off. However, many other kinds of conveyors, belts, tracks, or the like on which a garment-holding fixture can be transported in a known orientation could also be adapted for use with a system of the present invention.

Figure 5:
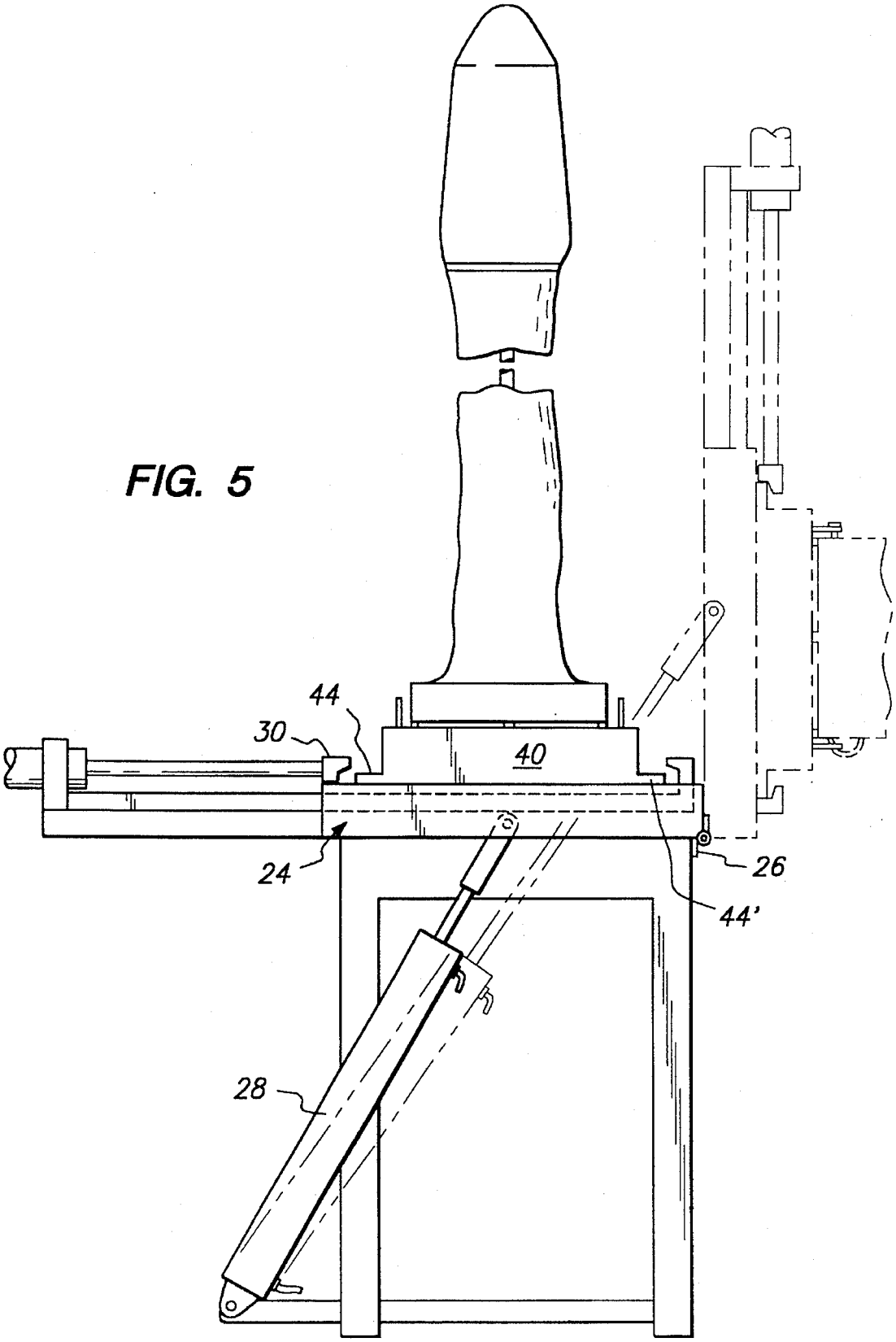
FIG. 5 is an elevated view of a loading/unloading station showing in solid line fashion a tilting section in the horizontal position for operation, and in broken line fashion the tilting section in the vertical position for loading/unloading.

Conveyor 10 includes one or more loading and unloading stations 22, which preferably include a tilting conveyor section 24 which is attached to the conveyor rails by one or more hinges 26 preferably aligned along an outside edge facing the operator, thus enabling the conveyor section 24 to be rotated from a horizontal position as shown in solid line fashion in FIG. 5, to a substantially vertical position for placing garments onto, and removing finished garments from, the fixture 40 as shown in dotted line fashion in FIG. 5. A clamp 30, or other locking device, is preferably included to lock the fixture 40 on the tilting section 24 when section 24 is placed in a vertical position for garment loading/unloading. Clamp 30 can be actuated manually, but is preferably actuated by a hydraulic or pneumatic cylinder and functions by pinning the flanges 44, 44' on fixture 40 as shown in FIG. 5. A hydraulic or pneumatic cylinder 28 is also preferably used for moving the conveyor section 24 from horizontal to vertical and back again. As shown in FIG. 1, cylinder 28 and clamp 30 can be simultaneously controlled, for example, by an operator using a foot pedal or a hand switch on control panel 91.

Figure 6:
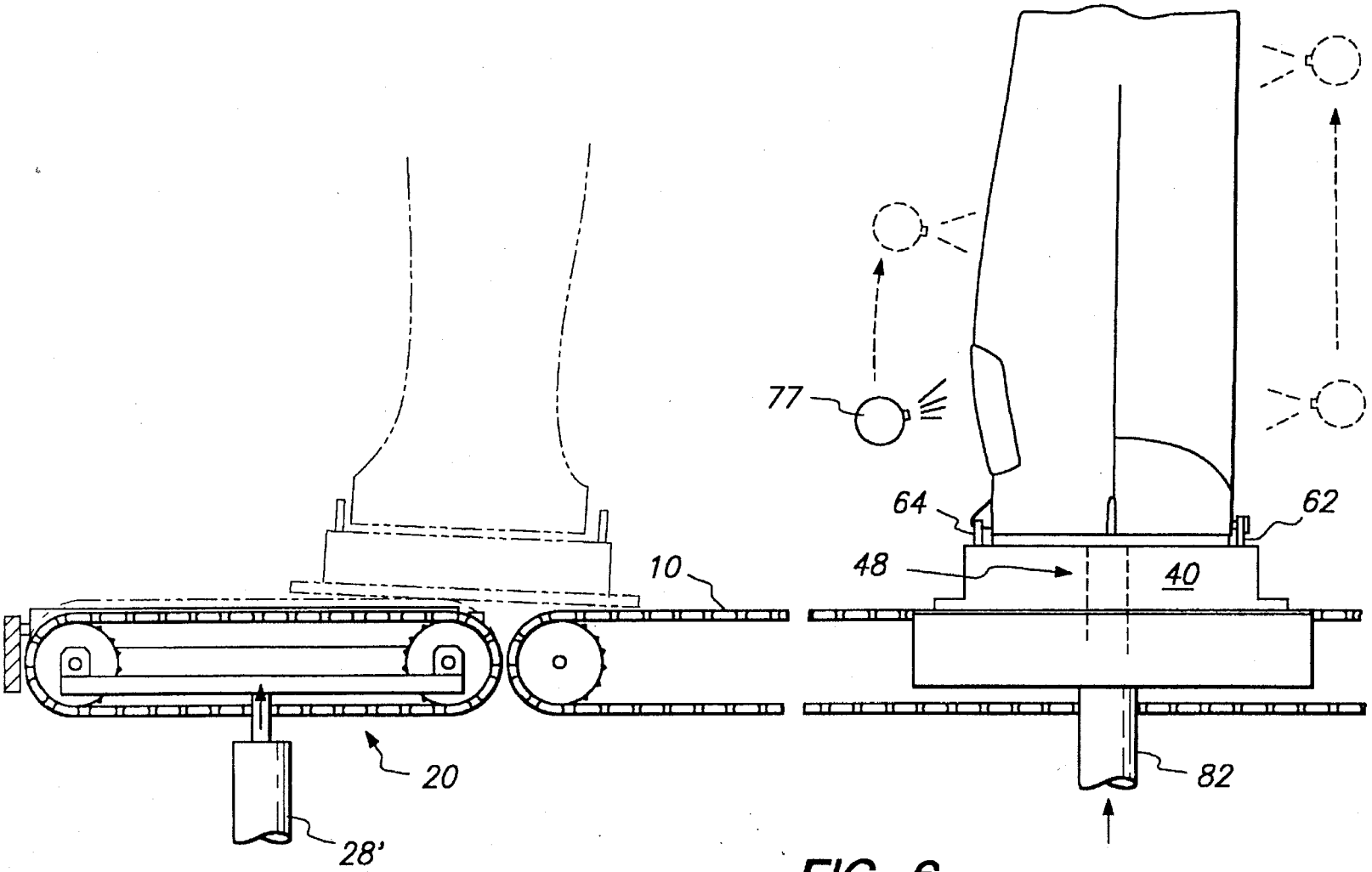
FIG. 6 is a side view of a pair of pants mounted on a fixture on the conveyor, showing in broken line fashion the position of the fixture and deflated garment before reaching a finishing station, and showing in solid line fashion the fixture and inflated garment at the finishing station.

As shown in FIG. 1, the conveyor 10 can be constructed with one or more branches 16, 16' and turns 18, 18' to enable the fixtures 40 to be selectively directed to different processing stations 70. Fixture 40 can be moved onto a branch 16 in many ways, for example, by using a stop gate 20 or a rotating table 34, or by constructing the branch 16 at a different elevation, for example higher than the main conveyor 10, and by arresting the movement of the fixture and moving it up and onto the branch using, for example, hydraulic or pneumatic cylinders as shown in FIG. 6.

The conveyor 10, in combination with the fixture 40, is designed to maintain the orientation of the garments as they pass through the system, to enable effective computer control of the finishing equipment and the substantial reproduction of any desired finish. As can be appreciated, the orientation of the fixture, and hence the garments, will undergo a predictable change as the fixture traverses each turn 18 or is shuttled off onto a branch 16. Accordingly, it may be desirable to provide a rotating table 34 at a 90 degree turn, such as that shown in FIGS. 1 and 7–8 as 18', to enable the fixture 40 to be turned to a more desirable orientation. For example, as shown in FIG. 1, if the fixture 40 were permitted to simply turn the corner at 18', the garments would reach the loading/unloading stations 40, 40' in an orientation which is 180 degrees from the starting orientation, with the front of the garments facing the operator. This is not desirable if the operator wishes to unzip the fly on the garment after the tilt table 24 is placed in a vertical orientation for unloading the finished garment, since the zipper will be on the bottom rather than on the top of the tilted garment. To avoid this situation, a rotating table 34, shown in detail in FIGS. 7 and 8, can be installed at 18' to rotate the fixture 40 by 90 degrees to reorient the fixture to its original orientation for delivery to an unloading station 22' to allow for easy unloading of the finished garment. A rotating table 34 could be installed anywhere along conveyor 10 where it is desirable to reorient the fixture 40.

Providing a fixed, known and predictable orientation of the garment is very important when trying to accurately reproduce local finishing effects. For example, the reproduction of the worn outline of a wallet or snuff box in the rear pocket can be accurately duplicated if all the garments in the batch are presented to the robot 76 in the same position and orientation at the finishing station 70. The preferred way of achieving accurate orientation of the garment is by fixing the orientation of the garment relative to the fixture 40, and then controlling the orientation of the fixture 40 relative to the robot. This insures that all garments are presented to the robot 76 in a precisely known orientation every time.

Figure 7:
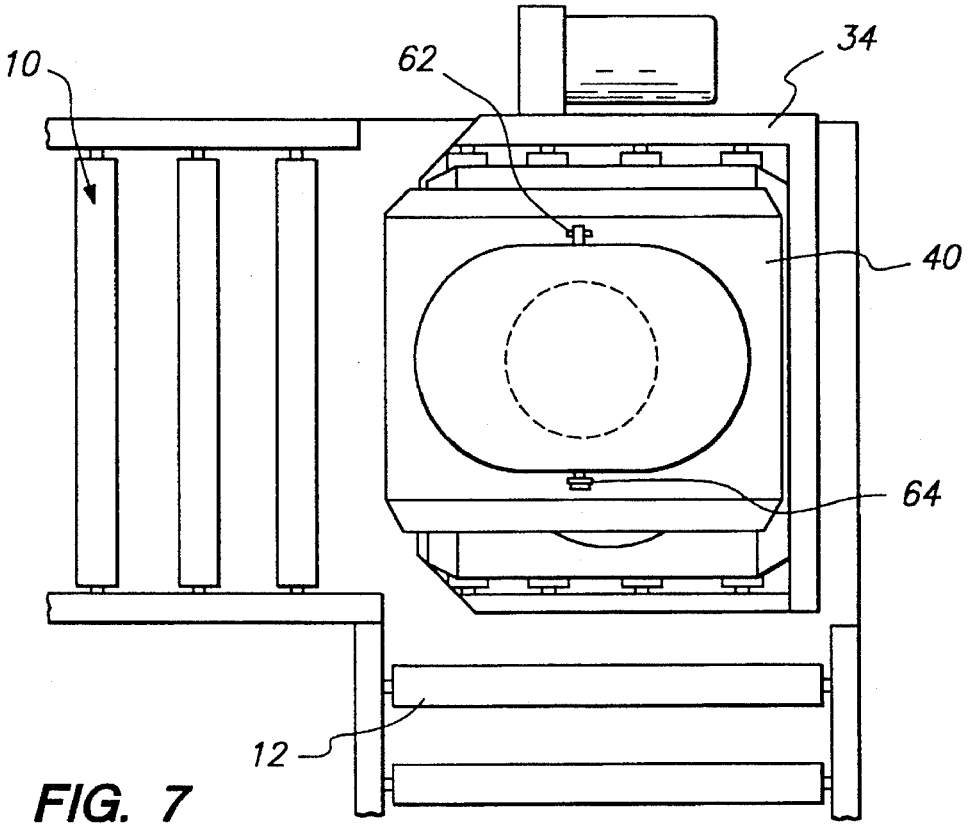
FIG. 7 is a top view of a fixture on the conveyor as it approaches a 90 degree turn in the conveyor.
Figure 8:
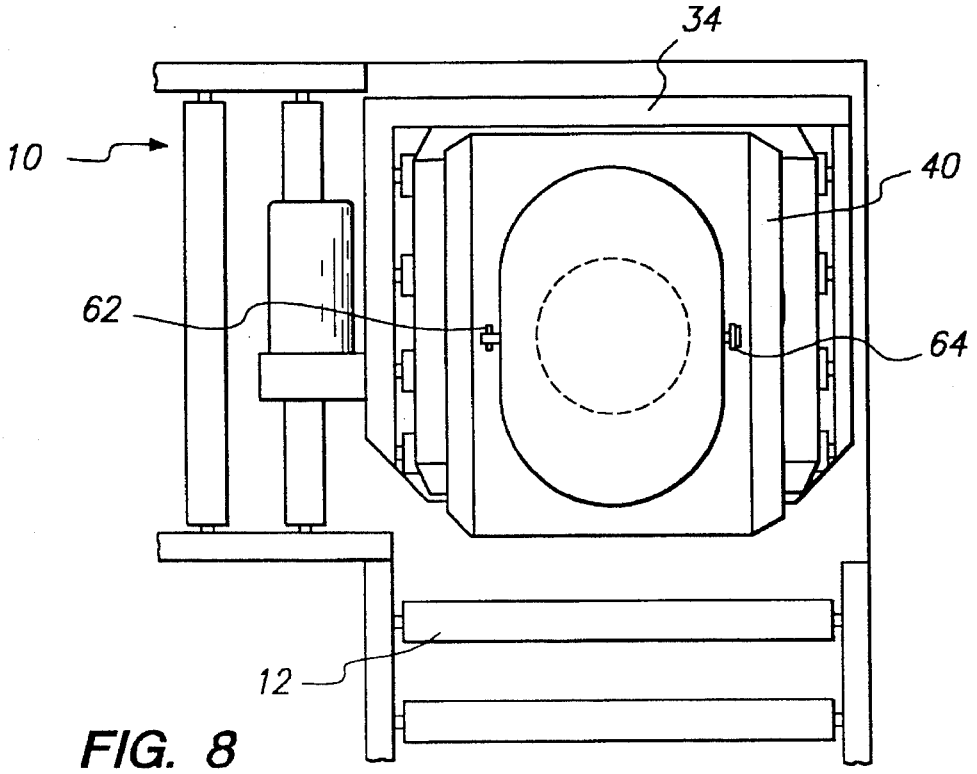
FIG. 8 is a top view of a fixture on the conveyor after it has been rotated 90 degrees on a rotating conveyor section.

The fixture 40 may be located accurately by any conventional means. The preferred means includes rails 14 which keeps edges of fixture 40 aligned on conveyor 10 and prevents skewing of the fixture 40 relative to conveyor 10. Thus, so long as the path of fixture 40 on conveyor 10 is known, the relative orientation of the garment will be known at any point along the conveyor 10. As noted above, to provide the garment at an optimum orientation at the finishing station 70, or to change the orientation of the garment to a known, different orientation at a desired location anywhere along conveyor 10, a rotating table 34, as shown in FIGS. 7 and 8, can be included for rotating the fixture 40 in 90 degree increments relative to the conveyor 10. This may be particularly desirable to reorient the fixture 40 after it has traversed one or more turns 18 or branches 16.

As shown in more detail in FIGS. 2–5, the fixture 40 includes a base 42 having a lower surface 45 and an upper surface 46. Base 42 can also be provided with one or more flanges 44, 44' or similar structures which can interlock with a clamp 30 or other locking devices provided on loading or unloading tilting section 24, as shown in FIGS. 1 and 5. Base 42 is preferably made of any rugged material such as aluminum. Lower surface 45 is preferably substantially flat for sliding on the rollers 12 of the conveyor 10, and includes an air duct 48 for permitting a stream of air from beneath the fixture 40 to be directed through the base 42.

Figures 2, 2A:
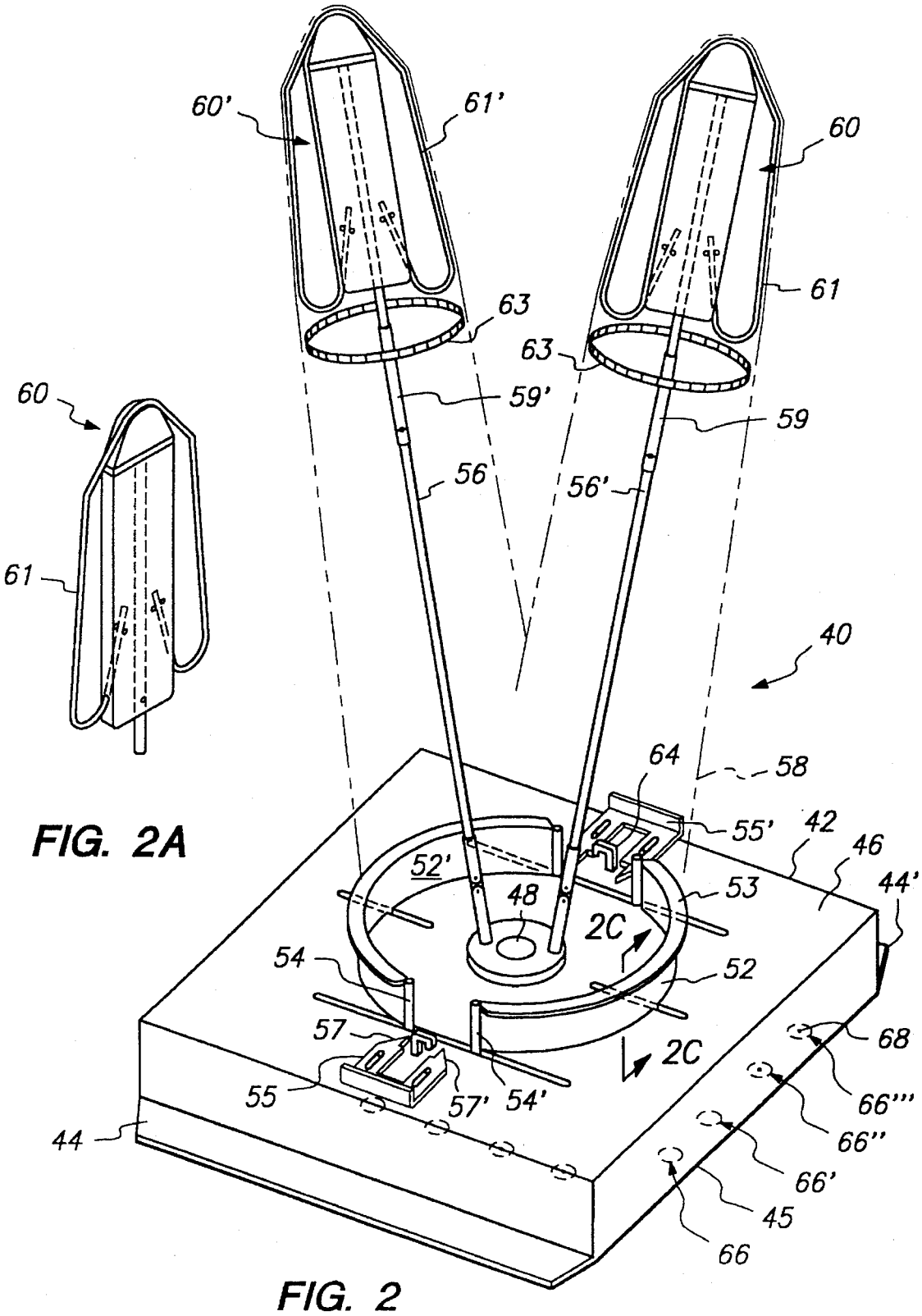
FIG. 2 is a perspective view of a fixture of the present invention, with the inflatable form shown in broken line fashion.
FIG. 2A is a perspective view of a cuff locator of the present invention as shown in FIG. 2.
Figure 2B:
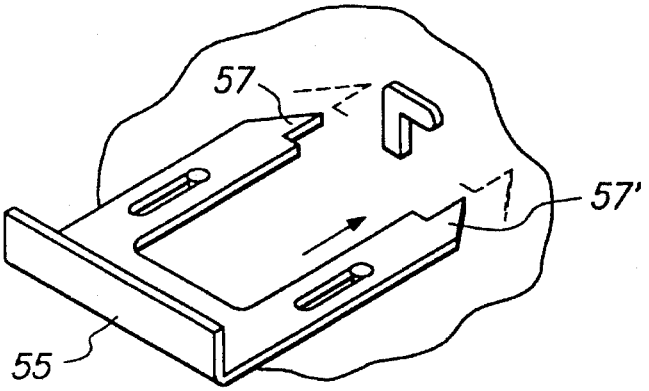
FIG. 2B is a perspective view of a sliding lock of the present invention as shown in FIG. 2.
Figure 2C:
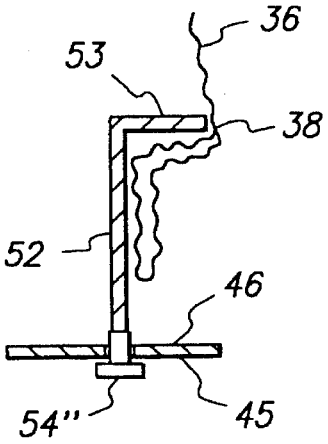
FIG. 2C is a cross-sectional view of a waist strap of the present invention taken through line 2C—2C of FIG. 2.

A means for automatically identifying each individual fixture 40 can also be advantageously provided on the lower surface 45. For example, a row of magnetically detectable identification elements 66, 66' can be provided on each base 42 for forming a unique binary number on each fixture 40. Elements 66 are preferably formed from teflon (or other non-magnetic) plugs flush mounted on the lower surface 45 of the base 42 as shown in FIG. 2, and located to pass over magnetic sensors 74, 74' mounted at desired locations along the conveyor 10 as shown in FIG. 1. A magnetic element, such as a steel bolt head 68, can be flush mounted in the center of one or more of the teflon plugs. The non-magnetic plugs without magnetic elements will be sensed as having an "off" or a binary value of "0", while the nonmagnetic plugs with magnetic elements will be sensed as having an "on" or a binary value of "1". Thus, if a row of four identification elements 66, 66', 66", 66'" is provided on the lower surface 45 of the fixture base 42, and the identification elements 66", 66'"have magnetic elements 68, 68' inserted as shown in FIG. 2, the binary identification number for the fixture, as determined by a magnetic sensor, would be 0011. If the magnetic elements 68, 68' were inserted into identification elements 66, 66', the binary identification number for the fixture 40 would be 1100. The number of identification elements 66 installed should preferably be sufficiently large to provide a unique identification number for each fixture used on the finishing line. In the event the fixture 10 is turned or re-oriented during travel on conveyor 10, it may also be desirable to provide two or more rows 69, 69' of identical identification elements 66, to enable the sensing of the identification number from several orientations.

While the magnetic identification system described above is preferred, one skilled in the art will recognize that there are many other ways of tracking fixture 40 through the system if desired. For example, a row of lamps or a fiber optic bundle could be arrayed on the fixture for alignment with detecting photocells at various points along the conveyor, with a "1" assigned to every activated lamp or fiber optic end, and a "0" assigned to regions where there is no light. Devices with more than two states could also be used. For example, a radio transmitter could be associated with each fixture for broadcasting a pre-programmed unique signal or for broadcasting at a unique frequency, which is detectable by a receiver. In a simple, seriatim finishing system, fixtures could alternatively be identified by counting. While a means for tracking the individual fixtures 40 through the system is advantageous and preferred, particularly in a complex finishing system with many identical finishing stations, it is by no means necessary when the system is used to finish batches of like garments in the same way.

The upper surface 46 of the fixture base 42 is preferably substantially flat, and preferably includes a series of spaced apart, parallel slots 50, 50', 50", 50'" for permitting the mounting and expansion of an inflatable garment form 58 for expanding the garment to its full three-dimensional size by filling and stretching the fabric of the garment to eliminate wrinkles and creases. Waist straps 52, 52' can be mounted on the upper surface 46 for slidable movement by means of mounting posts 54, 54', 54", 54'", 54"" which are preferably arrayed along the bottom edge of each waist strap 52, 52' and are captured in, and can slidably move along, the entire length of slots 50, 50', 50", 50'". The waist straps 52, 52' and their mounting posts 54, 54', 54", 54'", 54"" can be constructed from any suitably rugged material, including, for example, steel, aluminum, structural plastics or the like, and can expand outward to fully extend the waist of the mounted garment. Waist straps 52, 52' are preferably spring biased away from opening 48, so that the waist straps 52, 52' will engage and automatically fully extend the waist band of a pair of trousers mounted on the fixture 40. Waist straps 52, 52' can also be provided optionally with an upper flange 53 for bearing against the waist band seam 38 of a mounted garment 36. To aid-in mounting the garment, the waist straps 52, 52' can be moved towards each other and locked in a compressed position using sliding locks 55, 55' which each include a pair of spaced apart fingers 57, 57' which slide under waist straps 52, 52' and which engage and hold the outside surface of posts 54, 54'.

Inside the waist straps 52, 52' is located an air duct opening 48 through which a stream of air can be directed to inflate form 58. Also inside the waist straps 52, 52' is located any support structure for supporting form 58 and for providing ease in mounting a garment thereon for processing, such as, for example, two rigid or semi-rigid spaced apart rods 56, 56', each of which support one leg of form 58, and which can be linked to and extend vertically up from the upper surface 46 of the base 42. Rods 56, 56' can be constructed from wood, metal, plastic or any other similar suitable material. At the distal end of each rod 56, 56' is mounted a trouser cuff locator 60, 60'. Each cuff locator 60, 60' is formed from a formed, compressible spring 61, 61', which can be compressed to allow a trouser leg to be drawn over it as the trousers are mounted on fixture 40, and which will return to its normal orientation to expand and properly position and hold the cuff portion of the trouser frictionally from the inside during finishing. One or more spring assemblies 59, 59' can be provided along rods 56, 56' to enable the rod to compress along its length during garment mounting, to provide a force for stretching the legs of the mounted trousers to their fully extended position away from the trouser waistband to minimize or eliminate wrinkles in the garment during finishing.

Fastened inside waist straps 52, 52' and over air duct opening 48 is the inflatable form 58 which can be shaped to fit a wide variety of garments such as, for example, trousers. Trouser form 58 should be sufficiently large to enable it to expand to fill a variety of trouser sizes to their full three-dimensional form. Trouser form 58 also preferably has leg portions which terminate and are sealed around the distal end of each cuff locator 60, 60' as shown in FIG. 2. For ease in mounting and removing trousers from trouser form 58, the form 58 is preferably mounted to hold the trousers in an inverted orientation. Inflatable form 58 can be constructed from any suitable inflatable material, however, coated rip-stop nylon balloon fabric is preferred. Preferably, the trouser form is constructed in two parts, with the portion fitting over the cuff locator 60, 60' being constructed of somewhat heavier material and attached to the leg portion of the form 58 by conventional means such as, for example, zipper 63.

Outside of waist straps 52, 52' are preferably mounted additional means for securing the garment to the fixture and maintaining the garment's orientation on the fixture, such as front hook 62 and a rear hook 64. For example, once a pair of trousers is drawn over the legs of the inflatable form 58 and the waist straps 52, 52', as shown in FIG. 2, and the fly fastener is closed, the front hook 62 can be used to locate, center and secure the top fly closure button on the front of the trousers to the base 42, and rear hook 64 can be used to locate, center and secure a central belt loop on the rear of the trousers to the base 42.

All of these structures are preferred to allow the garment to be accurately mounted and oriented on the fixture. The waist straps 52, 52' are slidably mounted on the upper surface 46 of the base 42, and can be spring biased as noted above, to allow them to move outward against the inside of the trousers' waist band. Referring to FIG. 2, the parallel slots 50, 50', 50", and 50'" preferably permit the waist straps 52, 52' to move to and fro in one direction only. The sliding resistance is low enough that the air inflation pressure in the inflatable form 58 can push them outward. Thus, even when form 58 is inflated with air, the trousers continue to be held in a precisely-determined orientation relative to fixture 40. By spring-biasing the waist straps 52, 52' away from each other, the waist band of the trousers will be held in a precisely determined orientation even when form 58 is not inflated, for example during loading and unloading.

The trouser cuffs are also held at two other points, as each leg cuff is centered on the respective cuff locator 60, 60'. The rest of the garment is expanded at a finishing station 70 by the uniform pressure of compressed air. The result is that each trouser mounted on the fixture will assume the same orientation relative to the fixture base 42 during finishing as any other trouser.

As noted above, the conveyor 10 transports each fixture 40 to one or more finishing stations 70 where localized finishes can be provided to the garment mounted on each fixture 40. At each finishing station 70 is the equipment needed to apply the finish, such as blower 80 which can be activated when the air duct opening 48 of fixture 40 is aligned with the conduit 82 to inflate the form 58 and any garment mounted thereon; or computer-controlled robot 76, which can be equipped to wield a tool 77 such as a spray gun for spraying a bleaching agent or hot water for fading the inflated garment in preselected areas, paint or dye for applying a preselected design to the inflated garment, sand-blasting tools or wire or abrasive wheels, for abrasive wear and softening of selected areas on the inflated garment, or other tools to treat local areas, or the entire surface, of the inflated garment.

As shown in FIG. 1, a conveyor branch 16, 16' can be constructed on either side of robot 76 at finishing station 70 to reduce waiting. In this configuration, one robot can process a fixture mounted garment on branch 16 while another fixture mounted garment approaches on branch 16'.

Figure 3:
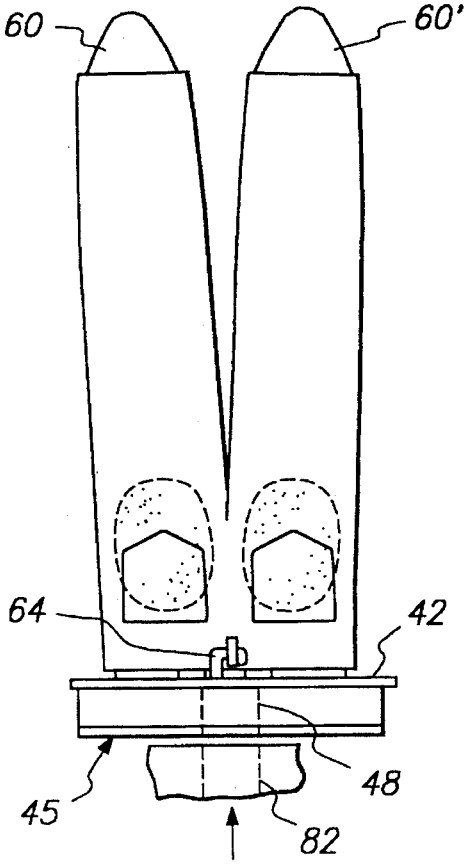
FIG. 3 is a rear view of a fixture of the present invention with mounted pants showing in dotted line fashion an exemplary area to which a faded finish can be applied.
Figure 4:
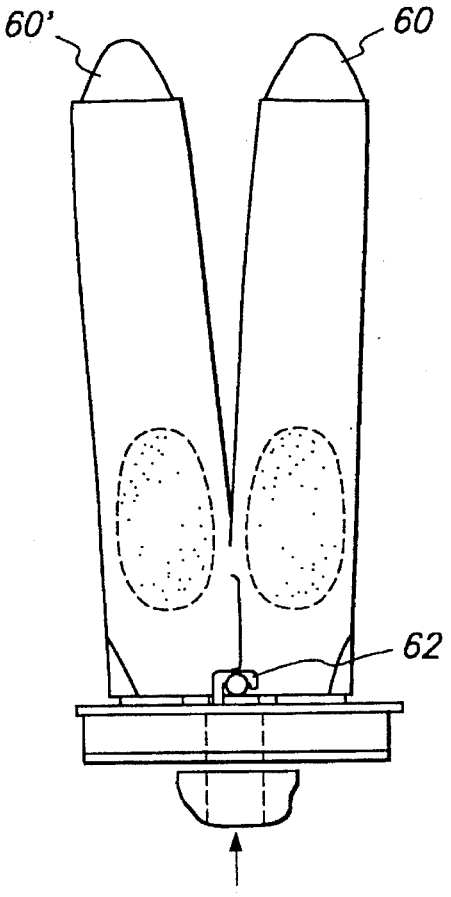
FIG. 4 is a front view of a fixture of the present invention with mounted pants showing in dotted line fashion an exemplary area to which a faded finish can be applied.

As shown in FIGS. 3–4 and 6, the air duct opening 48 is brought into alignment with air conduit 82 which feeds and directs air from the blower 80. A seal between opening 48 and conduit 82 is not required to inflate form 58; close proximity of the conduit 82 and the opening 48 will suffice to obtain full inflation of the form 58 during operation of blower 80.

Finishing stations 70 can be located inside a booth or environmental chamber 72 if desirable, for example to diminish or prevent the release of the chemicals used at the finishing station 70, or to dampen any noise which may be created during the finishing process. A vacuum pump (not shown) within the chamber 72 can be used to create slightly negative air pressure within the chamber 72 to prevent the escape of vapors, spray or dust by drawing outside air into the chamber 72 and through a filtration and/or condensation collection system. A drainage system (not shown) can also be provided, if desirable, to permit the collection of excess chemicals used in finishing, for reprocessing, reuse, or neutralization and disposal. Structures, such as flaps over the entry into and out of the chamber 72 can be provided as additional barriers, if desired. Any such barriers should be sufficiently flexible to permit the fixtures 40 and garments mounted thereon to pass easily into and out of the chambers through such structures.

The computer 90, shown in FIG. 1, receives information from the operator about the garments mounted on each fixture 40. For example, information concerning the size of the assembled garments and the finishing to be performed on each individual garment, or on a batch of garments, can be entered into computer 90 in many different ways, for example by the operator via a keyboard on control panel 91 or via a scanner (not shown). Thus, tags containing bar coded information concerning the size of the garments and the finish to be applied can accompany the batch and be scanned in by an operator using a hand-held scanner to provide the information to the computer prior to loading the garments in the batch onto fixtures. The computer 90 can then track each garment in the batch as it passes through the system, preferably using identification sensors 74 which are electronically linked to the computer 90 and which can be located at various desired locations along the conveyor 10. For example, an identification sensor 74 could be placed along conveyor 10 upstream of branch 16 to read the identification elements 66 on a passing fixture 40 and provide a signal to enable the computer to identify the fixture 40 and determine whether it should be allowed to pass on towards branch 16' or should be shuttled off onto branch 16. If the identification elements 66 are magnetic, the identification sensors 74 are preferably magnetic proximity switches. It is preferred that there be one identification sensor 74 for each identification element 66, and that the sensors 74 be positioned along the conveyor 10 so that the identification elements 66 will be horizontally aligned with the sensors 74 and within vertical sensing distance, so that the identification number for each fixture can be read. Preferably the sensors 74 are located beneath the conveyor 10, or are mounted between two rollers 12 on the conveyor 10 so that the identification elements 66 of each fixture 40 will pass over the sensors 74 as the fixtures 40 move along the conveyor 10.

The computer 90 can be programmed to shuffle a fixture 40 onto a branch 16 of the conveyor 10, stop the fixture 40 at a desired location, such as at a finishing station 70 over a blower 80, and inflate the form 58 by activating the blower 80. The computer can also activate and control the equipment at a finishing station 70, for example by determining the parameters for the finish based upon the size and orientation of the garment, and by controlling the movement of the robot 76, robot arm 78, and the tool 77. Thus, for example, the computer can determine from its internal programming and operator-furnished batch information what the opening on a spray head should be to apply a desired volume of chemical solution, and what preprogrammed movement is required to place the chemical solution on the specific area of the garment to achieve the desired result. The programming preferred for carrying out these functions is disclosed in the source code contained in the microfiche appendix to this application.

The computer 90 will typically be a personal computer, a time-share or sub-program part of a larger computer, a microprocessor, a hard-wired logic circuit, or other electronic device capable of receiving information from the operator and the sensors 74 concerning the garments mounted onto the fixtures 40 for finishing, and controlling the equipment such as the stop gates 20, rotating tables 34, the robots 76, the blowers 80. The robot 76 may also include logic circuits, a computer, or a microprocessor, in which case a separate computer 90 as illustrated in FIG. 1 might not be needed. Alternatively, a separate computer 90 could interact with a robot 76 having a computer.

Referring again to FIGS. 1–8, to use a system of the present invention, the operator begins by providing information to the computer 90 about the size(s), style(s) and/or type(s) of garments and the finishes to be applied. The fixtures 40 can be queued on the conveyor 10 in a numerical order, so that a batch of identical garments can be loaded onto a series of fixtures 40 whose identification numbers are recorded and tracked by the computer. Via the keyboard 36, or by a hand scanner used to read a bundle ticket, the operator can instruct the computer 90 to provide specific treatments to the batch on the fixtures being tracked. The computer can then control the progress of each garment in the batch through the system by routing them to the appropriate finishing stations 70 and controlling the robot 76, tool 77, and blower 80 to apply the desired finish. In particularly complex systems, with multiple identical finishing stations, the use of the computer 90 in combination with the fixture tracking system described in detail above, can be advantageously used to minimize queuing of garments on the conveyor 10 by routing the fixtures 40 to idle finishing stations, thus minimizing the total time .required for finishing the garments and maximizing the efficiency of the system.

Garments are loaded onto the fixtures 40 queued on the conveyor 10 by the operator who can activate the clamp 30 and hydraulic cylinder 28 to lock the fixture 40 onto the tilting section 24 and move the tilting section 24 to its vertical position, as shown in FIG. 5. The waist straps 52, 52' are compressed towards each other and locked in position by pushing the sliding locks 55, 55' towards the inflatable form 58. A garment such as the trousers shown in FIG. 1 are then pulled over the form legs so that the cuff portions of the trousers are expanded and supported by the cuff locators 60, 60', the trouser waist band is pulled over the waist straps 52, 52', and the front hook 62 is hooked around the top fly closure button on the front of the garment. If necessary, the front fly closure (buttons or zipper) is opened to enable the garment to be pulled onto the form 58, and then closed when the garment is mounted on the form 58. The tilting section 24 is then returned to its normal horizontal position, thus positioning the trousers in an inverted position as shown in FIGS. 3 and 4. The rear hook 64 is hooked around the center belt loop on the rear of the garment, and the sliding locks 55, 55' are moved away from the inflatable form 58, thus permitting the spring biased waist straps 52, 52' to move away from each other, engaging and stretching the waist band of the garment. The loaded fixture 40 can then be released from the tilt table 24 and moves down the conveyor 10, while the next fixture 40' in the queue is moved to the tilting section 24 and loaded. This process is repeated until all the garments in the batch have been loaded on fixtures 40.

As fixture 40 approaches branch 16, identification sensors 74 read the identification elements 66 on the base of the fixture 40 and send a signal to the computer 90. The computer 90 can then decide where fixture 40 should go. If computer 90 decides to send fixture 40 down branch 16, a stop gate 20 is activated, and fixture 40 is pushed or moved onto the branch 16 and continues towards finishing station 70.

As fixture 40 approaches finishing station 70, identification sensors 74' read the identification elements 66 on the base of the fixture 40 and send a signal to the computer 90. The fixture 40 can then be stopped by a stop gate 20, or by stopping the rollers 12, or both, at a predetermined location within reach of robot 76, over conduit 82. Blower 80 is activated to inflate form 58 and the attached garment. The computer 90 then controls the movement of the robot arm 78 and the attached tool 77 to provide the preselected finish. Because the orientation of the fixture with respect to the robot is known, and the orientation of the garment with respect to the fixture is also known, and the computer has the information regarding the size and shape of the garment, pattern predictability and consistency are assured since the robot can exactly reproduce any desired pattern on an unlimited number of garments (i.e., the first pair of the day and the last pair of the day can look the same, as can a pair produced one month in the future)—a task which is virtually impossible using human operators.

When the finishing step is completed, the blower 80 is deactivated, and fixture 40 is released and continues to travel down conveyor 10 to any other preprogrammed finishing stations. These could include, for example, the application of bleaches or dyes to selected areas of the garment, the mechanical abrasion of selected areas of the garment, washing of the garment, drying of the garment, and tagging of the garment. When finishing is completed, the fixture 40 is sent to an unloading station 22 where the fixture is again locked onto a tilting section 24, the waist straps 52, 52' are compressed towards each other and locked, the rear center belt loop of the trousers are disengaged from the rear hook 64, the tilting section 24 is moved to its vertical position, the top button is disengaged from the front hook 62, the fly fastener (e.g., buttons or zipper) is unfastened and the finished trousers are removed from the fixture 40.

One skilled in the art will recognize that it would be possible to construct the elements of the present invention from a variety of materials and to modify the placement of the components in a variety of ways. For example, while the finishing of trousers have been discussed in detail, it would be possible to construct fixtures for the automated finishing of other garments such as shirts and jackets using the teachings of this disclosure. Thus, while the preferred embodiments have been described in detail and shown in the accompanying drawings, it will be evident that various further modifications are possible without departing from the scope of the invention as set forth in the following claims.

We claim:

1. A fixture for use in an automated finishing apparatus, said automated finishing apparatus including a conveyor for moving said fixture to a finishing station, a means for maintaining the orientation of the fixture on the conveyor, and a computer for controlling the movement of the fixture and the equipment which performs finishing procedures, said fixture comprising:

a free standing base for floating movement along the conveyor;

a form on which a garment can be mounted and oriented for finishing, said form mounted to said base for supporting the garment; and, a means for holding the garment in a predetermined orientation relative to said base;

a means for identifying the fixture and distinguishing it from other fixtures, said means for identifying the fixture acting together with said computer wherein, when a garment is mounted and oriented on said form, and said fixture is placed upon the conveyor for movement to the finishing station, the orientation of the garment will be fixed and known to the computer regardless of its location on the conveyor, and the computer will be able to control the application of finishing procedures to preselected areas on the garment.

2. The fixture of claim 1 wherein said form is inflatable for expanding a garment mounted thereon to its substantially fully extended three-dimensional size.

3. The fixture of claim 2 wherein said base includes an opening for the flow of air into said form for inflation.

4. The fixture of claim 1 wherein said means for identifying said fixture is detected by one or more sensors arrayed along the conveyor and linked to said computer.

5. The fixture of claim 4 wherein said means for identifying said fixture comprises one or more non-magnetic plugs arrayed along said base, some or all of said plugs including magnetic elements and wherein said sensors are magnetic proximity switches.

6. The fixture of claim 2 wherein said inflatable form is shaped to fit inside a pair of trousers and includes a first leg portion, a second leg portion, and a lower trunk portion terminating in two or more waist straps slidably mounted on the base to permit expansion during inflation to stretch a waist band on the pair of trousers to its fullest expanded position.

7. The fixture of claim 6 additionally including a stiffening rod in each leg portion extending out of the end of the leg portions.

8. The fixture of claim 7 including a cuff supporter on the end of each stiffening rod.

9. The fixture of claim 6 wherein said means for holding the garment in a predetermined orientation relative to said base is a first hook for removably securing the top button of a fly closure of the trousers and a second hook for removably securing a center belt loop at the back of the trousers.

10. A fixture for use in an automated finishing apparatus, said automated finishing apparatus including a conveyor for moving said fixture to one or more finishing stations, a means for maintaining the orientation of the fixture on the conveyor, and a computer for controlling the movement of the fixture and the equipment which performs finishing procedures, and detectors mounted along conveyor and in communication with the computer for detecting the passage of said fixture, said fixture comprising:

a free standing base which can be selectively placed onto and removed from the conveyor;

an expandable form on which a garment can be mounted, oriented, and expanded to its substantially three-dimensional size for finishing, said form mounted to said base;

a means for expanding said form;

a means for preventing substantial shifting of the garment on said expandable form for retaining the garment in a desired, predetermined orientation relative to said base;

a sensor means mounted on said base in a location for cooperating with the detectors and providing a unique signal identifying said fixture;

wherein when a garment is mounted and oriented on said form, and said fixture is placed upon the conveyor for movement to the finishing station, the computer will be able to track said fixture and distinguish it from other fixtures on the same conveyor, and the orientation of the garment will be fixed and known to the computer regardless of its location on the conveyor, and the computer can control the application of desired finishing procedures to preselected areas on the garment.

11. The fixture of claim 10 wherein said expandable form is inflatable.

12. The fixture of claim 11 wherein said means for expanding said form includes a conduit communicating with said inflatable form and positioned on said fixture to direct a flow of air from an air flow source located at the finishing station to the interior of said inflatable form.

13. The fixture of claim 10 wherein said sensor means includes a plurality of magnetically detectable elements for forming a unique binary number which can be read by the detectors.

14. The fixture of claim 11 wherein said inflatable form comprises a bag shaped to fit inside a pair of trousers and including a first leg portion, a second leg portion, and a lower trunk portion terminating in two or more waist straps slidably mounted on the base to permit expansion during inflation to stretch a waist band on the pair of trousers to its fullest expanded position.

15. The fixture of claim 14 additionally including a stiffening rod in each leg portion extending out of the end of the leg portions.

16. The fixture of claim 15 including a cuff supporter on the end of each stiffening rod.

17. The fixture of claim 15 wherein said means for preventing substantial shifting of the garment includes a first hook for removably securing a waist band button of the trousers and a second hook for removably securing a center belt loop at the back of the trousers.

18. A fixture for use in an automated finishing apparatus, said automated finishing apparatus including a conveyor for moving said fixture to one or more finishing stations, a means for maintaining the orientation of the fixture on the conveyor, a computer for controlling the movement of the fixture and the equipment which performs finishing procedures, and detectors in communication with the computer and mounted at predetermined locations along the finishing apparatus for detecting the passage of the fixture, said fixture comprising:

a base adapted to be selectively placed onto and removed from the conveyor;

an inflatable form on which a garment can be mounted, oriented, and expanded to its substantially three-dimensional size, said form mounted to said base;

a conduit communicating with said inflatable form and positioned on said fixture to receive and direct a flow of air from an external air flow source to the inflatable form's interior;

a means for preventing substantial shifting of the garment on said inflatable form for retaining the garment in a desired, predetermined orientation relative to said base; and, a sensor means mounted on said base for generating a signal which provides a unique identification for said fixture which can be detected and identified by the detectors, whereby the computer can locate the fixture on the conveyor and distinguish it from similar fixtures traveling on the same conveyor, and can control the inflation of the form and application of desired finishing procedures to preselected portions of the garment.

19. The fixture of claim 18 wherein said sensor means includes a plurality of magnetically detectable elements for forming a unique binary number which can be read by the detectors.

20. The fixture of claim 18 wherein said inflatable form is shaped to fit inside a pair of trousers and includes a first leg portion, a second leg portion, and a lower trunk portion.

21. The fixture of claim 20 additionally including a stiffening rod in each leg portion.

22. The fixture of claim 20 wherein said means for preventing substantial shifting of the garment includes a first hook for removably securing the top button of a fly closure of the trousers and a second hook for removably securing a center belt loop at the back of the trousers.

* * * * *

UNITED STATES PATENT AND TRADEMARK OFFICE

CERTIFICATE OF CORRECTION

PATENT NO. : 5,593,072

DATED : January 14, 1997

INVENTOR(S) : GARY K. HESTER *ET AL.*

It is certified that error appears in the above-indentified patent and that said Letters Patent is hereby corrected as shown below:

At col. 14, line 9, after claim please delete "15" and insert --14--.

Signed and Sealed this

Sixth Day of May, 1997

Bruce Lehman

*Attest:*

BRUCE LEHMAN

*Attesting Officer*

*Commissioner of Patents and Trademarks*